US005205141A

United States Patent [19]

Singh

[11] Patent Number: 5,205,141

[45] Date of Patent: Apr. 27, 1993

[54] RECIPROCATING LAUNDRY BASKET FOR AN AUTOMATIC WASHER

[75] Inventor: Devinder Singh, St. Joseph, Mich.

[73] Assignee: Whirlpool Corporation, Benton Harbor, Mich.

[21] Appl. No.: 635,484

[22] Filed: Dec. 28, 1990

[51] Int. Cl.[5] ..... D06F 13/00

[52] U.S. Cl. ..... 68/53; 68/131; 68/132

[58] Field of Search ..... 366/228, 172; 68/53, 68/131, 132; 134/199, 153, 200

[56] References Cited

U.S. PATENT DOCUMENTS

| | | | |
|---|---|---|---|
| 193,090 | 7/1877 | Jenne et al. | 366/228 X |
| 731,573 | 6/1903 | Johnson | 366/228 X |
| 915,898 | 3/1909 | Sochurek, Sr. | 366/228 X |
| 1,204,357 | 11/1916 | Jefferson | 366/228 X |
| 1,426,435 | 8/1922 | Winkler | 366/228 X |
| 1,517,462 | 12/1924 | Rockwell | 366/228 X |
| 1,622,227 | 3/1927 | Lichterman . | |
| 1,627,931 | 5/1927 | Schroeder . | |
| 1,629,762 | 5/1927 | Woodrow . | |
| 1,849,896 | 3/1932 | Weiman . | |
| 2,062,668 | 12/1936 | Krauss . | |
| 2,156,541 | 5/1939 | Misenhimer et al. . | |
| 2,392,542 | 1/1946 | Matuszak | 366/172 X |
| 2,575,691 | 11/1951 | Smith . | |
| 2,692,494 | 10/1954 | Candor | 68/21 |
| 3,413,827 | 12/1968 | Kochanek | 134/191 X |
| 3,456,659 | 7/1969 | Tiby | 134/153 |
| 3,738,130 | 6/1973 | Smith . | |
| 4,438,074 | 3/1984 | Wilt | 366/172 X |
| 4,651,542 | 3/1987 | Kohsaka . | |
| 4,711,104 | 12/1987 | Ikeda . | |
| 4,711,105 | 12/1987 | Oida et al. . | |
| 4,742,698 | 5/1988 | Torita . | |
| 4,784,666 | 11/1988 | Brenner et al. . | |
| 4,835,994 | 6/1989 | Ishida et al. . | |

*Primary Examiner*—Frankie L. Stinson

*Attorney, Agent, or Firm*—Hill, Steadman & Simpson

[57] ABSTRACT

A reciprocating laundry basket for an automatic washer is provided in which the basket has a peripheral wall, a bottom wall contiguous with the peripheral wall, a post mounted within the basket for rotation with the basket, a spray device mounted on the post for spraying wash liquid into the interior of the wash basket and spray inlets and vertical fins positioned adjacent the peripheral wall for enhancing agitation of the fabric load.

18 Claims, 3 Drawing Sheets

FIG. 4
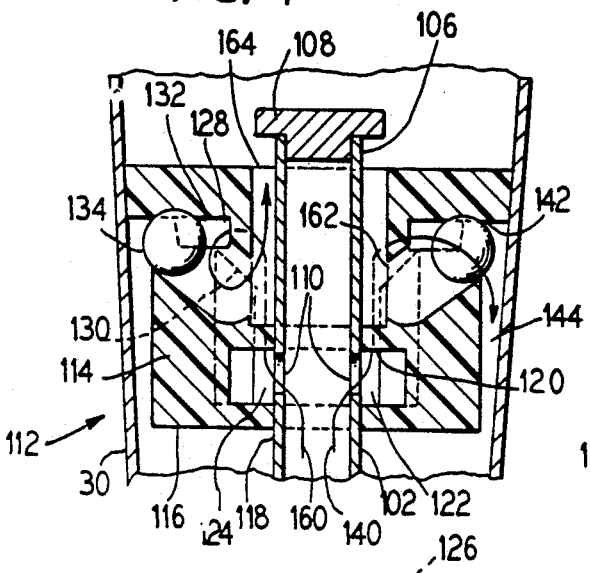
FIG. 5
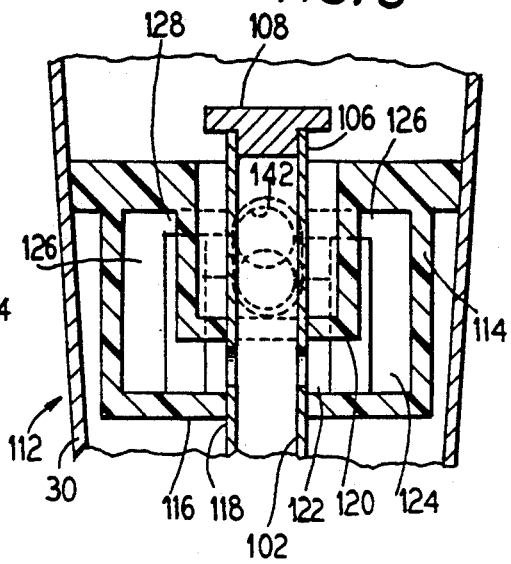
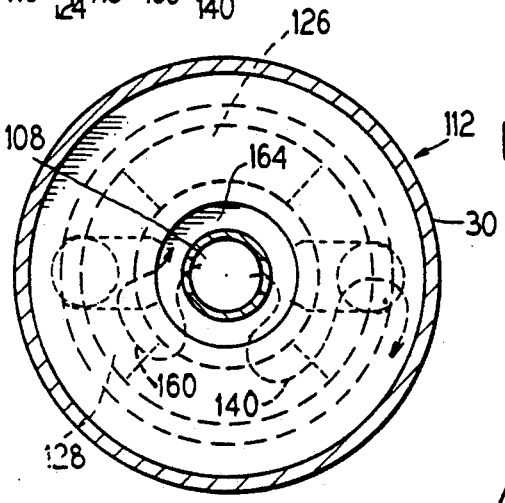
FIG. 6
FIG. 8
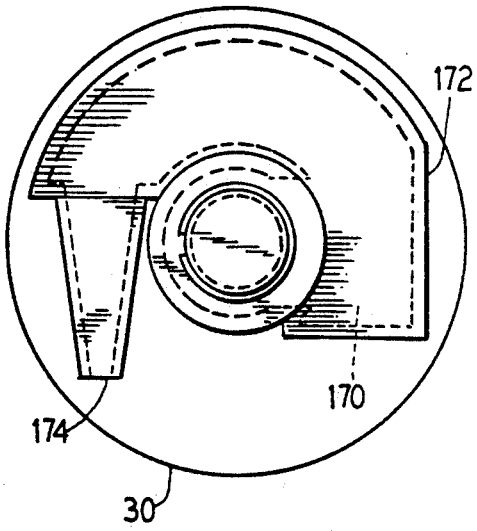
FIG. 7
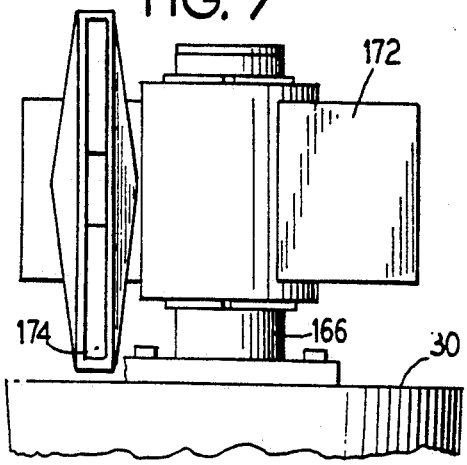

RECIPROCATING LAUNDRY BASKET FOR AN AUTOMATIC WASHER

BACKGROUND OF THE INVENTION

The present invention relates to automatic washers and more particularly to a wash basket for an automatic washer having agitation and spraying means associated therewith.

In automatic washing machines there generally is provided a basket for receiving clothes to be washed and an outer tub within which the basket is contained. In vertical axis machines oftentimes there is a central agitator which either oscillates or moves in some other fashion relative to the basket to enhance the flexing of the clothes in the wash fluid to improve washability. Generally in such washers, the liquid is introduced into the basket and clothes load through a nozzle fixed relative to the frame of the washer and protruding into an open top area of the basket, such as disclosed in U.S. Pat. No. 4,784,666.

In some constructions it is known to provide the laundry receiving vessel with a plurality of fins or other agitation enhancing devices protruding inwardly from the peripheral wall of the vessel. Such arrangements are shown in U.S. Pat. Nos. 1,627,931; 2,156,541; 2,575,691; 2,062,668; and 1,629,762.

In some constructions also known to provide a central vertically oriented structure which rotates or oscillates with the clothes receiving vessel. Such constructions are shown in U.S. Pat. Nos. 1,622,227; 1,849,896; 3,738,130; and 4,651,542.

SUMMARY OF THE INVENTION

The present invention provides a wash basket for receiving a load of fabric to be washed and which may be mounted concentrically within a tub for rotation and reciprocation relative to the tub. The wash basket has a peripheral wall and a central post mounted therein for rotation with the basket. The central post provides a liquid conduit for carrying wash liquid from the tub to a spray means. Preferably a spray means is mounted on the post for spraying wash liquid into the interior of the wash basket. Also, agitation enhancing means are positioned adjacent the peripheral wall of the basket for enhancing agitation of the fabric load.

The agitation enhancing means may comprise either or both of a spray means adjacent the peripheral wall to inject a spray of wash liquid into the interior of the tub or vertical fins carried on the peripheral wall.

BRIEF DESCRIPTION OF THE DRAWINGS

FIG. 4 is a side sectional view of a centrifugal valve arrangement as shown in FIG. 2.

FIG. 5 is a side sectional view of the centrifugal valve arrangement of FIG. 4, rotated 90°.

FIG. 6 is a top view of the valve arrangement of FIG. 4.

FIG. 7 is a side elevational view of the spray nozzle of FIG. 2.

FIG. 8 is a top view of the spray nozzle of FIG. 7.

DESCRIPTION OF THE PREFERRED EMBODIMENTS

Figure 1:
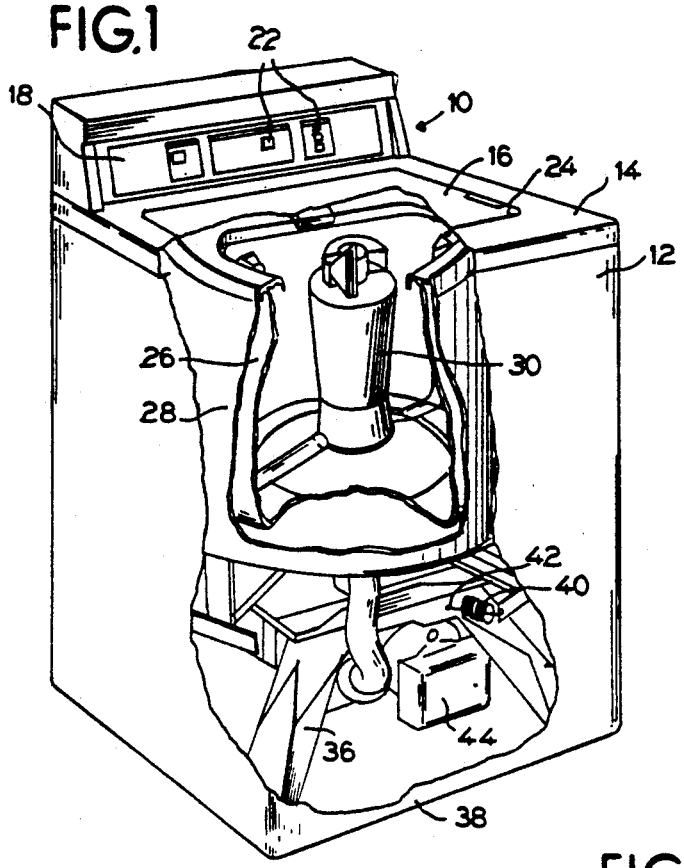
FIG. 1 is a perspective view, partially cut away, of an automatic washer embodying the principles of the present invention.
Figure 3:
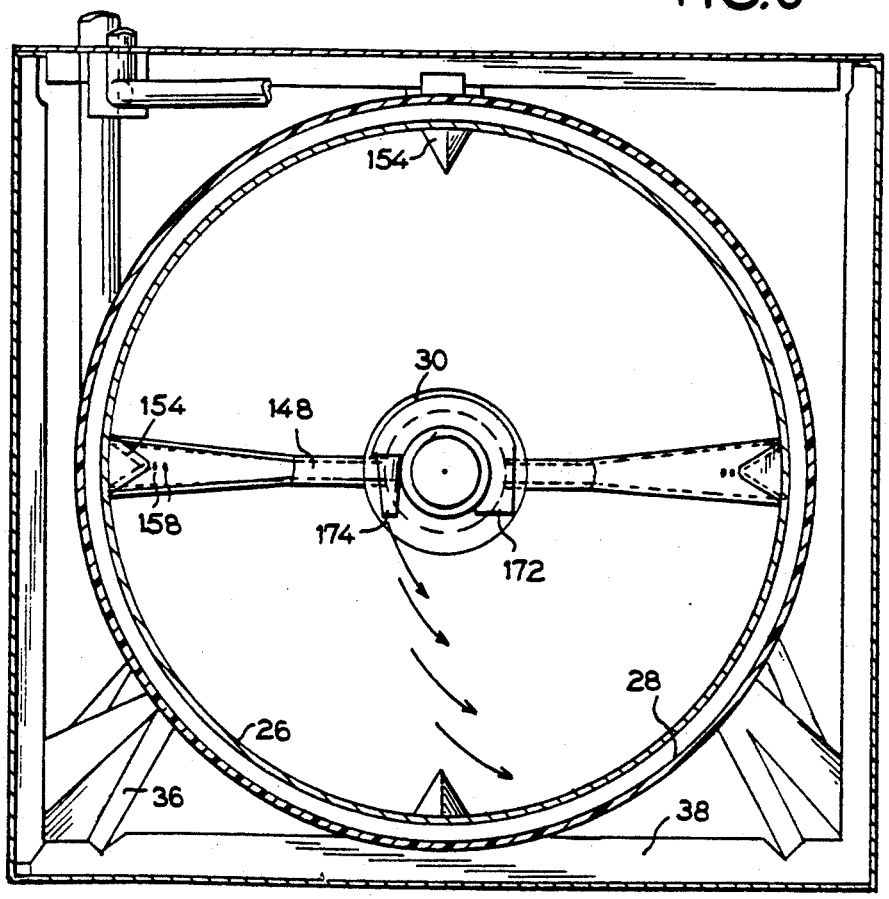
FIG. 3 is a plan view of the washer with the top wall of the cabinet removed.

In FIG. 1 there is illustrated an automatic washing machine generally at 10 having an exterior cabinet 12 with a top cabinet panel 14 and an openable lid 16 thereon. A control console 18 has a plurality of controls 22 to operate the washer through a series of washing, rinsing and fluid extraction steps. The openable lid 16 provides access to a top opening 24 through which a load of clothes can be placed into a perforate basket 26 which is concentrically carried within an imperforate tub 28.

In the place of a conventional agitator there is a central rigid post 30 which is mounted so as to be fixed relative to the basket 26, and thus to be rotatable with the basket, along a central vertical axis thereof.

Although the post 30 is shown as being a cylindrical member, it should be understood that the post could be any type of vertical structure and could have any type of geometric configuration.

The tub and basket assembly is supported by a conventional suspension system, including a plurality of legs 36 which are secured to a bottom frame 38. Counterbalancing means 40 are secured between the legs and another portion 42 of the suspension system. An electric motor 44 operates to drive the basket 26 in a rotary motion or in an oscillating motion depending on the particular wash cycle.

Figure 2:
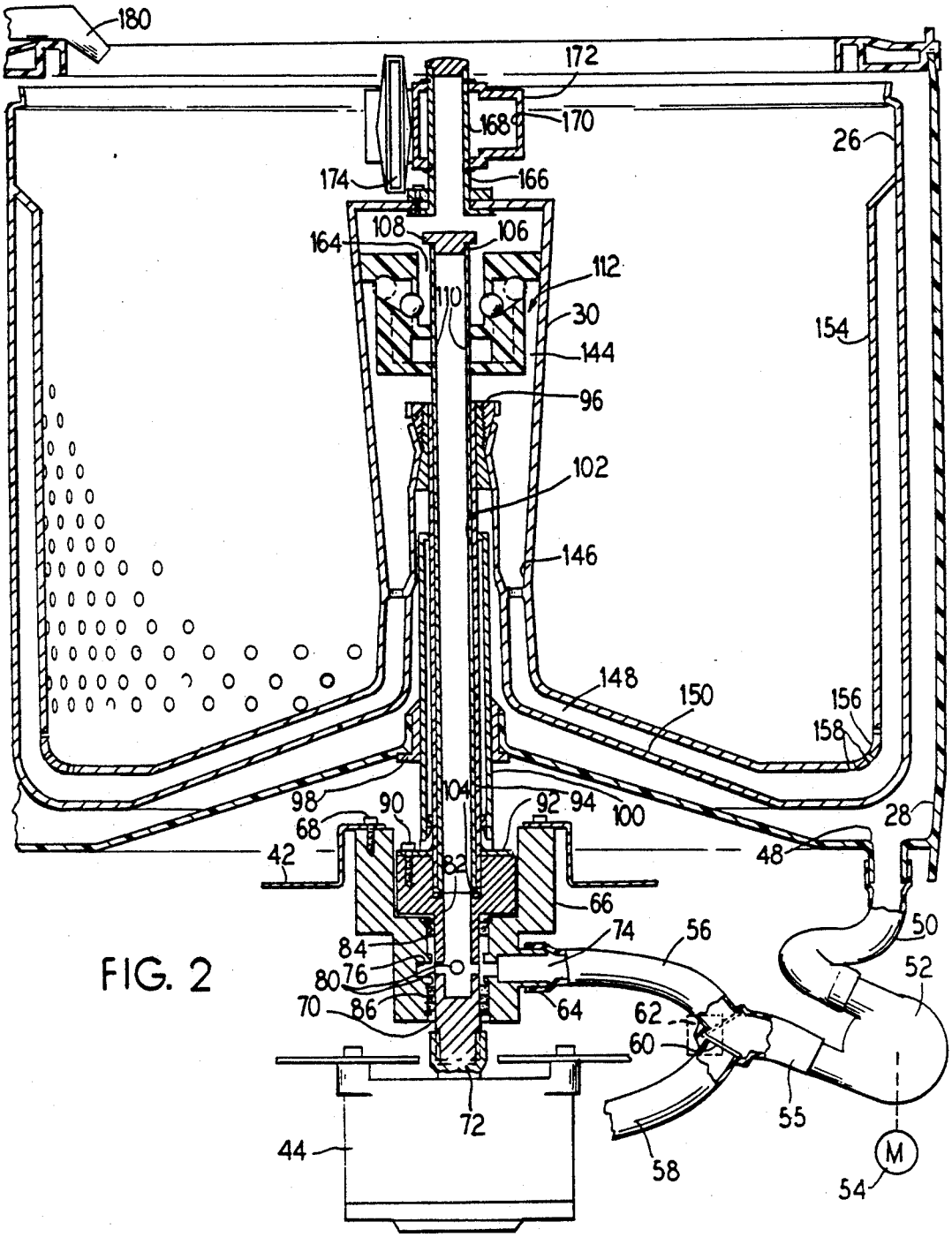
FIG. 2 is a side sectional view showing certain interior components of the washer of FIG. 1.

FIG. 2 shows the interior of the washer in greater detail in which it is seen that there is a drain area 48 positioned at a bottom of the wash tub 28 which connects to an outlet conduit 50. The outlet conduit 50 connects to a pump 52 which may be driven by a second motor 54. Proceeding from the pump 52 is a conduit 55 which has a Y connection with a first leg 56 and a second leg 58. In the Y connection there is a pivotable valve member 60 which is operated by a solenoid 62 to close either the first portion 56 or second portion 58. The second portion 58 extends to a drain for disposal of liquid in that portion and the first portion 56 attaches to an inlet fitting 64 for directing wash liquid into the interior of the post 30.

The inlet fitting 64 is formed on a coupling member 66 which is secured by means of appropriate fastening devices 68 to the portion 42 of the suspension system. The coupling member 66 is thus rigidly held against rotation. The coupling member 66 has formed therein a central passage 70 within which is received a drive member 72 which is to be coupled to the motor 44 either directly as shown in FIG. 2 or indirectly such as by means of belts, gears, clutches or other known power transmission arrangements.

The drive member 72 is free to rotate within the coupling member 66. The coupling member 66 has a radially directed passage 74 therein which opens through the connector 64 and which joins with an annular channel 76 formed in an interior diameter of the passage 70. The drive member 72 has a plurality of radial passages 80 which extend from an outer surface of the drive member to a central bore 82. Thus, wash liquid which flows in through conduit 56 and through passage 74 in the coupling member 66 will flood the annular channel 76 and be caused to flow into the radial passages 80 and into the bore 82 within the drive member. Appropriate seals 84, 86 are provided to prevent leakage of wash liquid along an outer surface of the drive member 72.

The drive member 72 is connected at an upper end, by appropriate fasteners 90 to a plate 92 secured to a spin tube 94. The spin tube 94 is connected to the wash basket 26 by a clamping arrangement at 96 within the post 30 as is known in the art. Thus, the basket will be drivingly connected to the drive member 72. The wash tub 28 is connected in a known manner at 98 to a centering tube 100. Carried within the spin tube 94, and rotating with it is a conduit tube 102 which communicates, at a bottom end 104 thereof with the bore 82 in the drive member 72. A top end 106 of the tube 102 is closed by a cap 108. At least two openings 110 are provided in the tube 102 which communicate with a centrifugal valve arrangement 112.

The centrifugal valve arrangement 112 is shown in greater detail in FIGS. 4–6.

The centrifugal valve arrangement 112 consists of a valve body 114 which has a bottom wall 116 with an opening 118 therethrough for receiving the tube 102. A central horizontal wall 120 is spaced above the bottom wall 116 so as to provide a chamber 122 within the valve body 114 within which are positioned the openings 110 in the tube 102.

The chamber 122 communicates with a pair of passages 124 disposed across from one another which lead radially outwardly from the chamber 122 and, at a radially outward position extend upwardly in a vertical passage portion 126 (FIG. 5). At the top of the vertical passage portions 126 there are two horizontal passages 128, bounded by a lower conical wall 130, which provide communication between the vertical passage portions 126 and a pair of upper chambers 132. The upper chambers 132 are generally cylindrical and are oriented radially, but at an angle from horizontal. Within each of the chambers 132 there is carried a ball 134 which is free to move within the chamber but which is sized to have a diameter approximately the same as the chamber.

When the basket 26 and thus the post 30 are at rest or are oscillating relatively slowly, the balls 134 will position themselves at a lower, radially inward end of the upper chamber 132 under the influence of gravity as shown in full lines in FIG. 2 and in phantom in FIG. 4. As this occurs, wash liquid which is directed by the pump 52 up through the tube 102 will follow the flow path indicated by arrow 140 (FIGS. 4 and 5). The wash liquid will leave the chambers 132 through an opening 142 at an upper, radially outward end of each chamber and will then flow into a space 144 between the valve body 114 and the center post wall 30.

As best seen in FIG. 2, the space 144 communicates at a bottom end 146 with a plurality of radial passages 148 extending along a bottom wall 150 of the basket to a plurality of vertical fins 154 formed at angularly spaced locations on the peripheral wall of the basket. At a junction 156 of the radial passages 148 with the fins 154 there are provided a plurality of apertures 158 providing communication between the radial passages 148 and the interior of the wash, basket thus providing a radially inwardly directed spray. Thus, when the wash basket is in the oscillation mode, with the pump 52 running, wash liquid will be recirculated from the drain 48 in the tub 28 to be reintroduced into the basket through the spray apertures 158.

When the wash basket is in a spin mode in which the basket spins at a relatively high rate of speed, centrifugal force causes the balls 134 to automatically move radially outwardly and thus upwardly in the cylindrical chambers 132 to effectively seal the openings 142. Wash liquid from the pump 52 then follows a flow path indicated by arrow 160 (FIGS. 4 and 6). When the wash liquid arrives in the cylindrical chambers 134, with the openings 142 blocked, the wash liquid exits through an opening 162 at a lower end of each cylindrical passage 132 into an annular space 164 between the valve body 114 and the tube 102.

The angle of the chambers 134 is selected, dependent on the weight of the balls 134, such that the balls will move outwardly when the rotation of the basket exceeds a predetermined speed which is greater than the rotational speed of the basket during the agitation portion of the wash cycle, but less than a rotational speed of the basket during the spin portion of the wash cycle.

Again as best seen in FIG. 2, the wash liquid continues to flow upwardly through a short tube 166 secured to a top of the post 30 and exits through a plurality of radial openings 168 into a chamber 170 formed in a nozzle member 172. The nozzle member 172 is shown in greater detail in FIGS. 7 and 8. The chamber 170 of the nozzle member 172 communicates with a vertically oriented spray nozzle opening 174 such that a wide fan of spray will be discharged from the nozzle in a vertical orientation. The nozzle member 172 is rotatingly supported on the short tube 166 and the nozzle opening 174 is oriented in a non-radial direction, preferably a tangential direction, and is offset from the rotational axis of the nozzle member, such that the reaction force of wash liquid leaving the nozzle will cause the nozzle member 172 to rotate on the tube 166 thus causing the nozzle member 172 to rotate relative to the basket. In this manner the wash liquid will be evenly distributed around the entire interior periphery of the basket through a horizontal extent of the full height of the basket while the basket is in the spin mode.

The washing machine construction disclosed herein is particularly suited for use with a wash method such as that disclosed in U.S. Pat. No. 4,784,666, assigned to the assignee of the present invention, and incorporated herein by reference. Specifically, such a washing process contemplates the use of a concentrated detergent solution, in the range of not less than 0.5% to 4% detergent concentration, in a limited amount, being sprayed against a rotating clothes load in the absence of mechanical agitation and recirculated through the clothes load a plurality times to effect a first cleaning step. When such a process is incorporated into the presently described machine, the nozzle member 172 will direct the concentrated wash fluid through the nozzle opening 174 against the spinning clothes load and, in view of the geometry of the nozzle opening, the wash liquid will be directed against the full height of the clothes load which will be held against the basket wall by centrifugal force. With the nozzle member 172 rotating relative to the basket 26, a complete wetting of the clothes load will be assured.

Following the initial concentrated wash step, additional water is introduced into the wash load to dilute the concentrated solution to a more normal or conventional concentration and a second washing step occurs during which time the clothes are agitated within the wash liquid bath. Although the presently disclosed washer does not include a centrally mounted agitator, the fins 154 projecting inwardly of the basket will provide an agitation force against the clothes load within the basket. Also, there may be fins of a similar construction on the post itself which will also impart an agitation force to the clothes load during oscillation of the basket.

Further, during the agitation portion of the wash cycle, wash liquid will be introduced and recirculated into the wash basket through the spray apertures 158 thus providing additional agitation force to the clothes load.

After the second washing step, the wash liquid is drained from the tub and the wash basket is spun to extract as much liquid from the clothes load as possible. Subsequently a rinsing of the clothes load occurs during which time water is sprayed against the rotating clothes load to remove dirt and detergent from the clothes. Part of such a spray rinse step could include a recirculation of the rinse spray which is collected in the tub and is redirected to the spray nozzle 172 by the pump, or fresh water may be delivered to the rotating clothes load with the collected water directed to drain. The fresh water would be directed into the spinning basket through a stationary nozzle member 180 (FIG. 2).

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. An automatic washer comprising;
a wash tub for receiving wash liquid;
a wash basket concentrically mounted within said tub for rotation relative to said tub;
a post mounted within said basket for rotation with said basket;
spray means mounted on said post for spraying wash liquid into the interior of said wash basket; and
agitation enhancing means positioned adjacent a peripheral wall of said basket into an interior of said basket for enhancing agitation of a fabric load positioned within said basket;
said agitation enhancing means comprising spray means for spraying wash liquid into the interior of said wash basket,

2. An automatic washer according to claim 1, wherein said post is mounted concentric with a rotational axis of said basket.

3. An automatic washer according to claim 1, wherein said agitation enhancing means comprises vertical fins on said peripheral wall.

4. An automatic washer comprising;
a wash tub for receiving wash liquid;
a wash basket concentrically mounted within said tub for rotation relative to said tub;
a post mounted within said basket for rotation with said basket;
spray means mounted on said post for spraying wash liquid into the interior of said wash basket; and
agitation enhancing means positioned adjacent a peripheral wall of said basket into an interior of said basket for enhancing agitation of a fabric load positioned within said basket;
said enhancing means comprising spray inlets for spraying wash liquid into said interior of said basket.

5. An automatic washer comprising;
a wash tub for receiving wash liquid;
a wash basket concentrically mounted within said tub for rotation relative to said tub;
a post mounted within said basket for rotation with said basket;
spray means mounted on said post for spraying wash liquid into the interior of said wash basket; and
agitation enhancing means positioned adjacent a peripheral wall of said basket into an interior of said basket for enhancing agitation of a fabric load positioned within said basket, said agitation enhancing means comprising vertical fins on said peripheral wall,
said vertical fins comprising wash liquid conduits and include spray inlets for spraying wash liquid into said interior of said basket.

6. A rotatable wash basket for receiving a load of fabric to be washed comprising:
a peripheral wall;
a bottom wall contiguous with said peripheral wall;
a post mounted within said basket for rotation with said basket;
spray means mounted on said post for spraying wash liquid into the interior of said wash basket; and
agitation enhancing means comprising spray means positioned adjacent said peripheral wall for enhancing agitation of said fabric load.

7. An automatic washer according to claim 6, wherein said post is mounted on said bottom wall.

8. A wash basket according to claim 6, wherein said agitation enhancing means comprises vertical fins on said peripheral wall.

9. A rotatable wash basket for receiving a load of fabric to be washed comprising:
a peripheral wall;
a bottom wall contiguous with said peripheral wall;
a post mounted within said basket for rotation with said basket;
spray means mounted on said post for spraying wash liquid into the interior of said wash basket; and
agitation enhancing means positioned adjacent said peripheral wall for enhancing agitation of said fabric load, said agitation enhancing means comprising vertical fins on said peripheral wall,
said vertical fins comprising wash liquid conduits and include spray inlets for spraying wash liquid into said interior of said basket.

10. A rotatable wash basket for receiving a load of fabric to be washed comprising:
a peripheral wall;
a bottom wall contiguous with said peripheral wall;
a post mounted within said basket for rotation with said basket;
spray means mounted on said post for spraying wash liquid into the interior of said wash basket; and
agitation enhancing means comprising spray means positioned adjacent said peripheral wall for enhancing agitation of said fabric load,
said agitation enhancing means comprising spray inlets for spraying wash liquid into said interior of said basket.

11. An automatic washer comprising:
a wash tub for receiving wash liquid;
a wash basket concentrically mounted within said tub for rotation relative to said tub;
a post mounted within said basket for rotation with said basket;

liquid conduit means in said post for carrying wash liquid from said tub to a spray means; and agitation enhancing means comprising spray means positioned adjacent a peripheral wall of said basket for enhancing agitation of a fabric load positioned within said basket.

12. An automatic washer according to claim 11, wherein said spray means is mounted on said post.

13. An automatic washer according to claim 11, wherein said post is mounted concentric with a rotational axis of said basket.

14. An automatic washer according to claim 11, wherein said agitation enhancing means comprises vertical fins on said peripheral wall.

15. An automatic washer according to claim 11, further including motive means for rotating said basket in an oscillatory manner relative to said wash tub.

16. An automatic wash comprising:

a wash tub for receiving wash liquid;

a wash basket concentrically mounted within said tub for rotation relative to said tub;

a post mounted within said basket for rotation with said basket;

liquid conduit means in said post for carrying wash liquid from said tub to a spray means; and agitation enhancing means positioned adjacent a peripheral wall of said basket for enhancing agitation of a fabric load positioned within said basket, said spray means comprising said agitation enhancing means.

17. An automatic washer comprising:

a wash tub for receiving wash liquid;

a wash basket concentrically mounted within said tub for rotation relative to said tub;

a post mounted within said basket for rotation with said basket;

liquid conduit means in said post for carrying wash liquid from said tub to a spray means; and agitation enhancing means positioned adjacent a peripheral wall of said basket for enhancing agitation of a fabric load positioned within said basket, said agitation enhancing means comprising vertical fins on said peripheral wall, said vertical fins comprising wash liquid conduits and include spray inlets for spraying wash liquid into said interior of said basket.

18. An automatic washer comprising:

a wash tub for receiving wash liquid;

a wash basket concentrically mounted within said tub for rotation relative to said tub;

a post mounted within said basket for rotation with said basket; liquid conduit means in said post for carrying wash liquid from said tub to a spray means; and agitation enhancing means positioned adjacent a peripheral wall of said basket for enhancing agitation of a fabric load positioned within said basket, said agitation enhancing means comprising spray inlets for spraying wash liquid into said interior of said basket.

* * * * *